US009115722B2

(12) United States Patent
Minami

(10) Patent No.: US 9,115,722 B2
(45) Date of Patent: Aug. 25, 2015

(54) FEED WATER PUMP CONTROL DEVICE

(75) Inventor: Masahiro Minami, Suzuka (JP)

(73) Assignee: FUJI ELECTRIC CO., LTD., Kawasaki-shi (JP)

( * ) Notice: Subject to any disclaimer, the term of this patent is extended or adjusted under 35 U.S.C. 154(b) by 308 days.

(21) Appl. No.: 13/879,022

(22) PCT Filed: Feb. 10, 2012

(86) PCT No.: PCT/JP2012/053081
§ 371 (c)(1),
(2), (4) Date: Apr. 11, 2013

(87) PCT Pub. No.: WO2012/140944
PCT Pub. Date: Oct. 18, 2012

(65) Prior Publication Data

US 2013/0216357 A1 Aug. 22, 2013

(30) Foreign Application Priority Data

Apr. 11, 2011 (JP) ..... 2011-087150

(51) Int. Cl.
*F04B 49/06* (2006.01)
*F04D 27/00* (2006.01)
*F04B 49/08* (2006.01)

(52) U.S. Cl.
CPC ..... *F04D 27/00* (2013.01); *F04B 49/065* (2013.01); *F04B 49/08* (2013.01); *F04B 2201/1201* (2013.01); *F04B 2203/0204* (2013.01); *F04B 2203/0208* (2013.01); *F04B 2203/0209* (2013.01); *F04B 2205/04* (2013.01); *F04B 2205/05* (2013.01); *F04B 2205/09* (2013.01)

(58) Field of Classification Search
CPC .... F04B 49/06; F04B 49/065; F04B 2205/01; F04B 2205/02; F04B 2205/04; F04B 2205/09; F04B 2203/0204; F04B 2201/1201; F04B 2205/05; F04B 2203/0209
USPC ..... 417/44.1, 44.2, 44.11, 44.3; 700/282
See application file for complete search history.

(56) References Cited

U.S. PATENT DOCUMENTS 5,941,690 A * 8/1999 Lin ..... 417/44.2
6,939,109 B2 * 9/2005 Takahashi et al. ..... 417/3

FOREIGN PATENT DOCUMENTS

EP 1072795 A1 1/2001
JP 53-064104 A 6/1978
JP 05-133343 A 5/1993

(Continued)

*Primary Examiner* — Charles Freay
*Assistant Examiner* — Philip Stimpert
(74) *Attorney, Agent, or Firm* — Rabin & Berdo, P.C.

(57) ABSTRACT

The presence or absence of boost pressure is determined from an error between F-P characteristics showing the relationship between the output frequency of an inverter and the power consumption and an actual operating point. When there is boost pressure, an amount of correction of linearized characteristics showing the relationship between quantity and discharge side pressure is automatically calculated based on the error, and the linearized characteristics are corrected. Subsequently, by carrying out a PID control in accordance with a target pressure obtained from post-correction linearized characteristics, the output frequency of an inverter unit is controlled, and an estimated constant end pressure control is carried out. Because of this, a pressure sensor or quantity sensor on a pump intake side is rendered unnecessary, and a simplification and reduction in cost of a feed water pump control device are possible.

7 Claims, 8 Drawing Sheets

(56) References Cited

FOREIGN PATENT DOCUMENTS

| | | | |
|---|---|---|---|
| JP | 11-159468 | A | 6/1999 |
| JP | 2000-054982 | A | 2/2000 |
| JP | 2001-123962 | A | 5/2001 |
| JP | 2003-090288 | A | 3/2003 |
| JP | 2004-316434 | A | 11/2004 |
| JP | 2007-040135 | A | 2/2007 |
| JP | 2010-012338 | A | 1/2010 |

* cited by examiner

FEED WATER PUMP CONTROL DEVICE

TECHNICAL FIELD

The present invention relates to a feed water pump control device that detects boost pressure (feed water pump intake side pressure) without the installation of a pressure sensor or quantity sensor on the intake side of a feed water pump, and carries out an estimated constant end pressure control.

BACKGROUND ART

Normally, a feed water pump control device installed in an office building or condominium is such that an estimated constant end pressure control, which controls water pressure at a demand end to a virtual constant by controlling a feed water pump discharge side pressure, is employed.

The estimated constant end pressure control can be employed without problem in a feed water pipe system wherein a water tank, or the like, is installed on the intake side of the feed water pump, and boost pressure changes little. However, in the kind of case wherein the feed water pump is connected directly part way along the feed water pipe, the boost pressure changes depending on the status of water use, meaning that, when controlling so that the feed water pump discharge side pressure is a constant end pressure, it may be difficult to supply an amount of water appropriate to the amount of water that should be fed.

When the head height (the discharge side pressure at a time of maximum quantity) in the feed water pump is clear, the boost pressure is detected by a pressure sensor installed on the intake side of the feed water pump, and by applying the boost pressure to an appropriate formula, it is possible to obtain simple linearized characteristics showing the relationship between the operating frequency of the feed water pump and the discharge side pressure. By controlling the operating frequency of the feed water pump in accordance with the simple linearized characteristics so that the discharge side pressure is such that the estimated end pressure is constant, an estimated constant end pressure control is theoretically possible.

According to the heretofore described method, although the discharge side pressure at a time of maximum quantity virtually coincides with the simple linearized characteristics, errors occur in the relationship between the quantity and discharge side pressure in a quantity range from zero until reaching a maximum value.

In particular, in an office building or condominium, it is very rare that the feed water pump is operated for a long time at maximum quantity, and normally it is often the case that operation is at half maximum quantity or less. Consequently, errors are likely to occur between the actual discharge side pressure of the feed water pump and the originally necessary discharge side pressure, as a result of which, there is a problem in that there is wasteful expenditure on electricity costs and water costs, which works against resource and energy saving.

Also, although it is also feasible to carry out an estimated constant end pressure control using two analog detection values, from a quantity sensor that detects the actual quantity and a discharge side pressure sensor, two sensors are necessary in this case.

Herein, as feed water pump control devices using an estimated constant end pressure control, those described in, for example, JP-A-5-133343 and JP-A-2001-123962 are publicly known.

The heretofore known technology according to JP-A-5-133343 includes an inverter device 106 and motor M for driving a pump P, pressure sensors 101 and 107 installed on the intake side and discharge side respectively of the pump P on a feed water pipe 200, pressure selection means 102, target pressure computing means 103, rotation speed control means 104, and rotation speed detection means 105, as shown in FIG. 5.

The heretofore known technology according to JP-A-5-133343 is such that the target pressure computing means 103 obtains a target pressure signal S3 in accordance with the rotation speed of the motor M using an intake side pressure signal S2X, and outputs the target pressure signal S3 to the rotation speed control means 104. A first setting pressure PA and a pressure signal PBX from the pressure selection means 102 are input into the target pressure computing means 103. The pressure selection means 102 outputs the larger of a second setting pressure PB, smaller than the first setting pressure PA, and the pressure signal S2X as the pressure signal PBX.

The rotation speed control means 104 controls the output frequency of the inverter device 106 so that the discharge side pressure signal S2 coincides with the target pressure signal S3, thereby operating the motor M.

According to the heretofore known technology, when the intake side pressure signal S2X exceeds the second setting pressure PB, it is possible to reduce the pump P discharge side pressure, even when the boost pressure is abnormally high, by substituting the setting pressure PB with the pressure signal S2X, and continuing operation.

Also, the heretofore known technology according to JP-A-2001-123962 includes pressure sensors 101 and 107 installed on the intake side and discharge side respectively of a pump P, a subtractor 108, maximum frequency computing means 109 and minimum frequency computing means 110, end target pressure computing means 111, moving average means 112, subtraction means 113 that obtains a deviation between a target pressure, which is the output of the moving average means 112, and a discharge side pressure detection value, proportional integral means 114, and addition means 115 that adds the output of the proportional integral means 114 and an actual inverter frequency $f_{in}$, thereby obtaining a frequency command value of the inverter device 106, as shown in FIG. 6.

A maximum quantity $Q_{max}$ is input into the maximum frequency computing means 109, while a maximum setting pressure $P_{max}$, a minimum setting pressure $P_{min}$, and the inverter frequency $f_{in}$ are input into the end target pressure computing means 111.

The heretofore known technology according to JP-A-2001-123962 is such that the maximum frequency computing means 109 and minimum frequency computing means 110 obtain a pressure difference ΔP between the discharge pressure and intake pressure of the pump P, and a maximum frequency $f_{max}$ and minimum frequency $f_{min}$ from the maximum quantity $Q_{max}$. Also, the end target pressure computing means 111, using the maximum frequency $f_{max}$, minimum frequency $f_{min}$, maximum setting pressure $P_{max}$, minimum setting pressure $P_{min}$, and inverter frequency $f_{in}$, computes a target pressure P using a predetermined formula. Then, by the proportional integral means 114 adding a deviation between a moving average value of the target pressure P obtained by the moving average means 112 and a discharge side pressure detection value to the inverter frequency $f_{in}$, using a proportional integral computation, a frequency command value of the inverter device 106 is computed.

As this heretofore known technology is such that the target pressure P is computed using the maximum frequency $f_{max}$ and minimum frequency $f_{min}$, based on the pressure difference ΔP between the discharge pressure and intake pressure of the pump P, a highly accurate estimated constant end pressure control, unaffected by disturbance, is possible.

OUTLINE OF THE INVENTION

Problems to be Solved by the Invention

According to the heretofore known technologies according to JP-A-5-133343 and JP-A-2001-123962, it is possible to carry out an estimated constant end pressure control while keeping the discharge pressure of the pump P virtually constant. However, as the pressure sensor 101 that detects the pump P intake side pressure is essential in both cases, there is a problem in that the overall cost of the equipment increases.

Therefore, an object of the invention is to render unnecessary a pressure sensor or quantity sensor on the pump intake side, thereby enabling a reduction in the cost of the feed water pump control device.

Also, another object of the invention is to carry out an estimated constant end pressure control by controlling the pump discharge pressure to a predetermined value, thereby achieving resource saving and energy saving.

Means for Solving the Problems

The invention is premised on a water feed pump control device that carries out an estimated constant end pressure control by controlling the operating speed of a feed water pump installed in a feed water pipe with an inverter device so that the discharge side pressure of the feed water pump is positioned on a pipeline resistance curve.

Further, the invention is such that, when an error occurs between F-P characteristics showing the relationship between the output frequency of the inverter device and the power consumption and an actual operating point, it is determined that there is pump boost pressure. When there is boost pressure, an amount of correction of linearized characteristics showing the relationship between the output frequency of the inverter device and the pump discharge side pressure is automatically calculated using the error between the F-P characteristics and the actual operating point (the inverter device output frequency error), and the linearized characteristics are corrected using the correction amount and a pump discharge side pressure detection value. Subsequently, an estimated constant end pressure control is carried out using proportional, integral, and differential control based on post-correction linearized characteristics.

Advantage of the Invention

According to the invention, an error in the F-P characteristics corresponding to the boost pressure is detected without using a pressure sensor or quantity sensor on the pump intake side, and the linearized characteristics are corrected using the error, meaning that a simplification of equipment, a reduction in cost, and a resource saving are possible.

Also, as the linearized characteristics correspond to the pipeline resistance curve, it is possible to suppress the pressure generated by the pump by an amount equivalent to the boost pressure, and operate the pump at an optimum number of rotations. Because of this, an energy saving operation of a feed water pump that carries out an estimated constant end pressure control is possible.

MODE FOR CARRYING OUT THE INVENTION

Hereafter, a description will be given, based on the drawings, of an embodiment of the invention.

Figure 1:
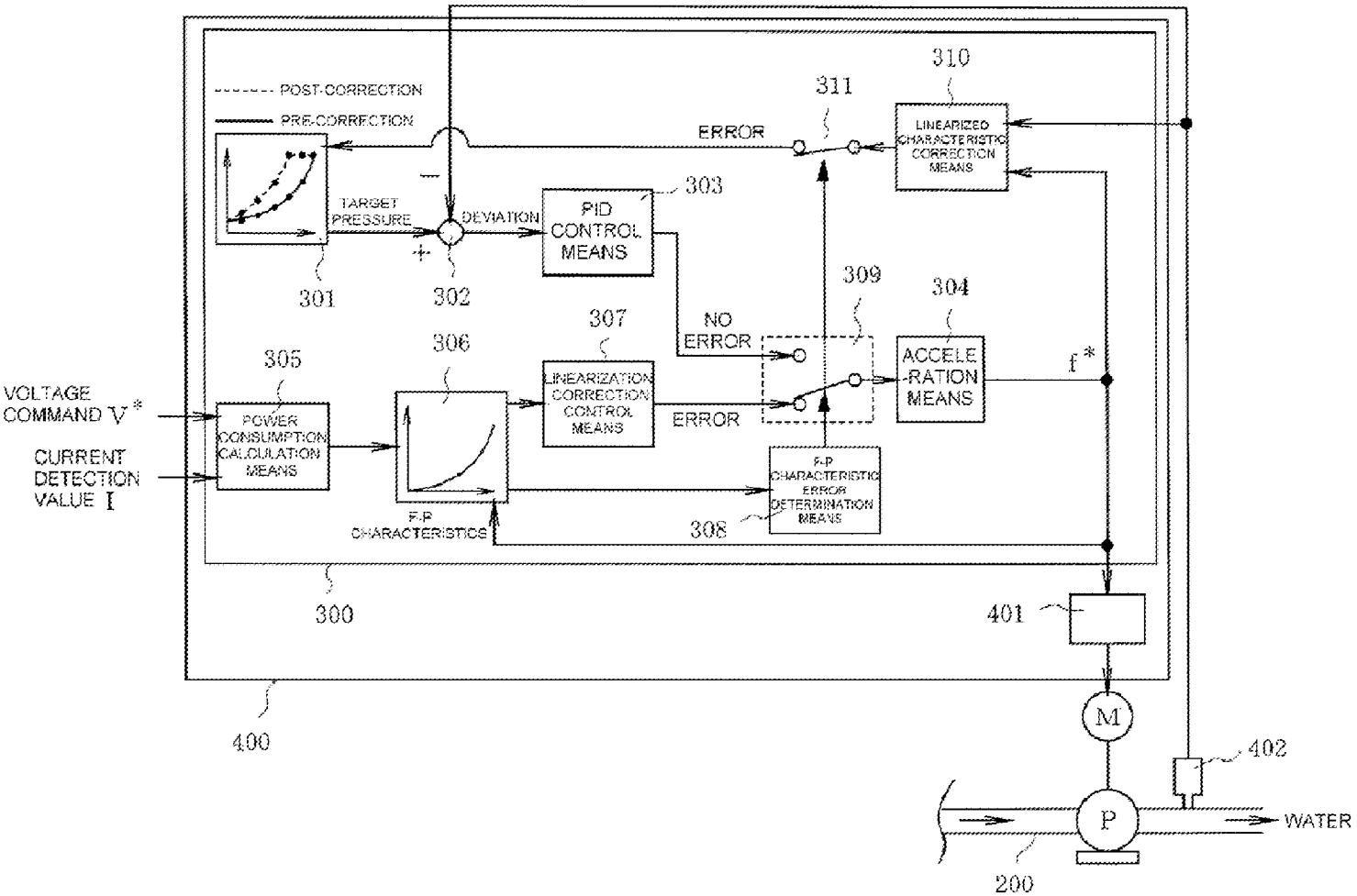
FIG. 1 is a block diagram showing an overall configuration of an embodiment of the invention.

FIG. 1 is a block diagram showing an overall configuration of the embodiment. In FIG. 1, an inverter unit 401 drives a motor M by generating a frequency based on a frequency command f* output from an inverter control unit 300 and an alternating current voltage of an amplitude in accordance with the frequency, thereby operating a feed water pump P. 200 is a feed water pipe for feeding water.

The inverter control unit 300 is control processing means incorporated in an inverter device 400, and is configured of, for example, a CPU, a memory, a PID regulator, an A/D converter, an input/output interface, and the like. The inverter device 400 is configured of the inverter control unit 300 and the inverter unit 401.

In the inverter control unit 300, linearized characteristics 301 are characteristics showing a relationship between the pump P drive frequency (the output frequency of the inverter unit 401) and the pump P discharge side pressure. In FIG. 1, linearized characteristics when there is no pump P boost pressure are shown by a solid line, while linearized characteristics when there is boost pressure are shown by a broken line. In the embodiment, it being characterized by the linearized characteristics for when there is no boost pressure being corrected and used when there is pump P boost pressure, the solid line characteristics are also called pre-correction linearized characteristics, and the broken line characteristics post-correction linearized characteristics.

The pre-correction linearized characteristics are essentially the same as a pipeline resistance curve preset in accordance with a feed water pipeline in order to carry out an estimated constant end pressure control, and the linearized characteristics are stored in a memory (not shown) as a function or data table.

Figure 3:
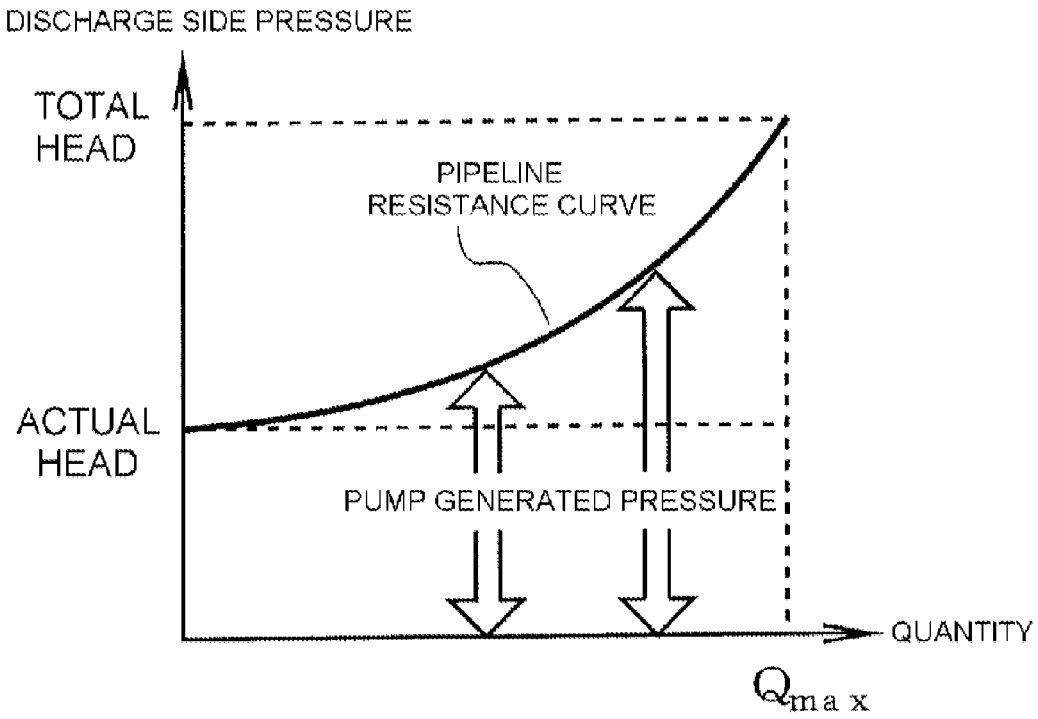
FIG. 3 is an illustration of quantity-head characteristics (Q-H characteristics) 1 when there is no pump boost pressure.

Herein, the pipeline resistance curve is also referred to as quantity-head characteristics (Q-H characteristics), as shown in FIG. 3), wherein the head when there is no boost pressure is equivalent to the pressure generated by the pump. For the sake of convenience, the pipeline resistance curve shown in FIG. 3 is referred to as quantity-head characteristics (Q-H characteristics) 1.

In FIG. 1, a target pressure chosen from the discharge side pressures of the linearized characteristics 301 is input into subtraction means 302 together with a discharge side pressure detection value from a pressure sensor 402 on the discharge side of the pump P. A deviation calculated by the subtraction means 302 is input into PID control means 303, and an output thereof is input into acceleration means 304 via switching means 309. Herein, as the operation of the switching means 309 is controlled by F-P characteristic error determination means 308, to be described hereafter, the output of the PID control means 303 is provided to the acceleration means 304 via the switching means 309 at a normal time when there is no boost pressure. Also, as the operation of switching means 311 is also controlled by the F-P characteristic error determination means 308, to be described hereafter, the switching means 311 is opened in the case of "No error", and closed in the case of "Error".

The PID control means 303 is configured of a regulator that carries out proportionality, integral, and differentiation calculations in order that the deviation should be zero. The acceleration means 304 calculates the frequency command f* based on the output of the PID control means 303, and outputs the frequency command f* to the inverter unit 401.

Figure 2:
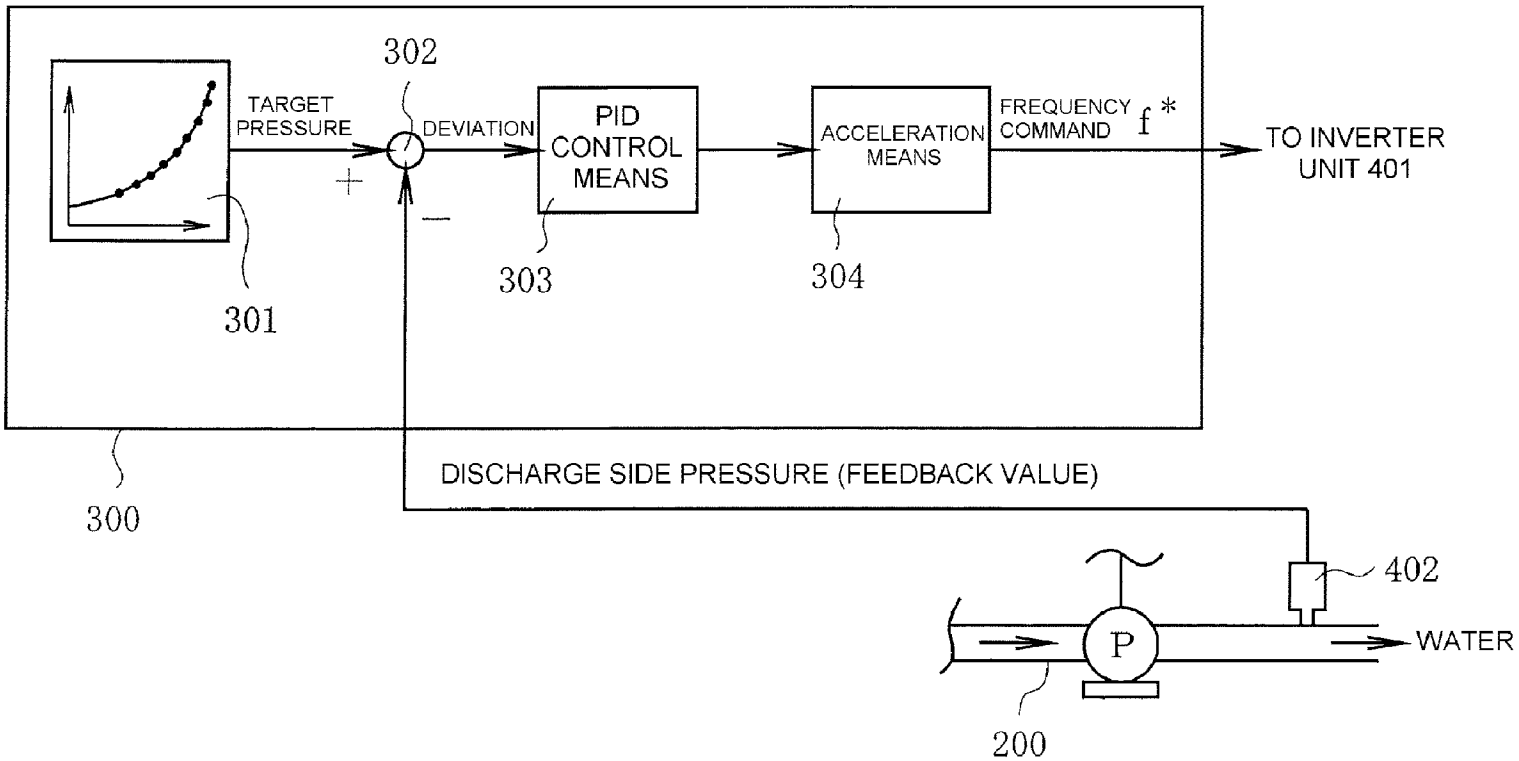
FIG. 2 is a block diagram equivalently showing a feedback control system when there is no pump boost pressure in FIG. 1.

An equivalent of a feedback control system when there is no pump P boost pressure is as shown in FIG. 2.

Also, in FIG. 1, 305 is power consumption calculation means that calculates the power consumption of the inverter unit 401. The power consumption calculation means 305 calculates the power consumption of the inverter unit 401 based on a voltage command V* generated inside the inverter unit 401 (or an inverter unit 401 output voltage detection value) and an inverter unit 401 output current detection value I.

306 is frequency-power characteristics (F-P characteristics) showing the relationship between the output frequency and power consumption of the inverter unit 401 calculated by the power consumption calculation means 305, which are stored in the memory as a function or data table. The F-P characteristics 306, being practically constant regardless of whether or not there is boost pressure, are, for example, the kind of characteristics shown by the solid line in FIG. 4C. The F-P characteristics 306 set and store the power consumption of the inverter unit 401 with respect to the output frequency of the inverter unit 401 when operating the pump P or when checking operation during maintenance work. At this time, it is possible to compile the F-P characteristics 306 by substituting the pump P drive shaft power with the power consumption of the inverter unit 401.

Now, when assuming that there is no pump P boost pressure, the PID control means 303 operates with a predetermined discharge side pressure for carrying out an estimated constant end pressure control as a target pressure, and the frequency command f* is calculated by the acceleration means 304 and provided to the inverter unit 401. The relationship at this time between the output frequency of the inverter unit 401 and the discharge side pressure can be represented by, for example, the linearized characteristics of the solid line of FIG. 4B, wherein the relationship between a frequency $F_a$ of the inverter unit 401 and the discharge side pressure is maintained at an operating point A. As the frequency of the inverter unit 401 is proportional to the quantity, the linearized characteristics of the solid line of FIG. 4B coincide with the pipeline resistance curve of FIG. 3.

Figure 4A:
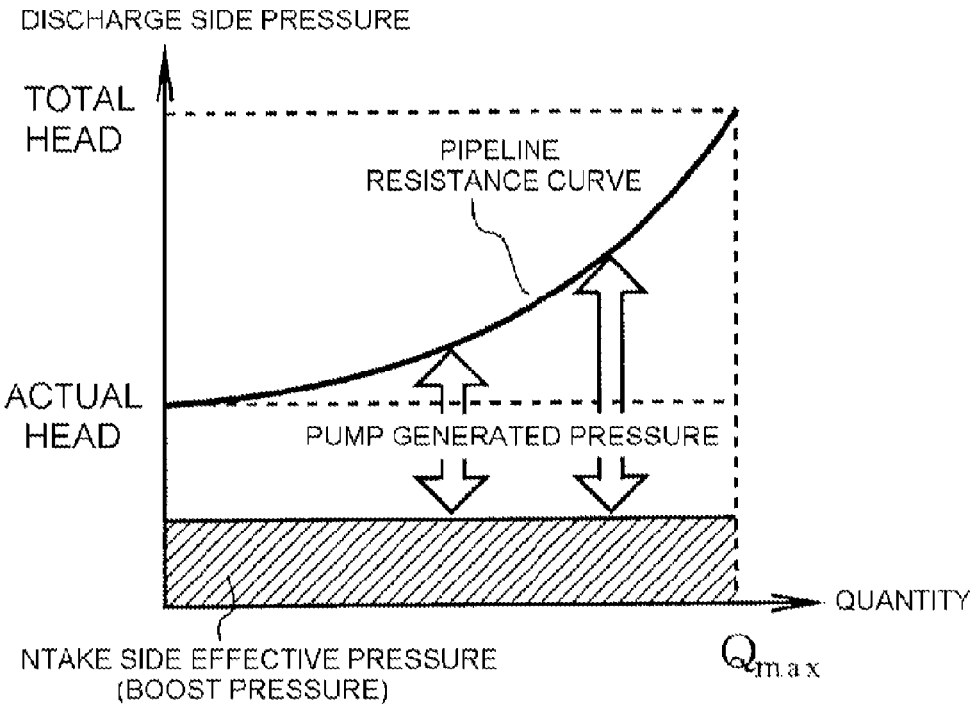
FIG. 4A is an illustration of quantity-head characteristics (Q-H characteristics) 2 when there is pump boost pressure.

However, when there is boost pressure, it should be permissible that the pressure generated by the pump is smaller by an amount equivalent to the boost pressure acting as an intake side effective pressure, as is clear from a comparison of the pipeline resistance curves of FIG. 3 and FIG. 4A. Herein, for the sake of convenience, the pipeline resistance curve of FIG. 4A is referred to as quantity-head characteristics (Q-H characteristics) 2.

However, when operation of the inverter unit 401 is continued at the operating point A when there is boost pressure, the pump P is caused to rotate excessively with respect to the amount of feed water that is to be provided, and the inverter unit 401, motor M, and pump P consume wasteful energy. That is, as the operating point of the F-P characteristics of the inverter unit 401 of FIG. 4C deviates from the optimum value in this condition, it is necessary to return the operating point to within the F-P characteristics (that is, to correct the linearized characteristics).

Figure 4B:
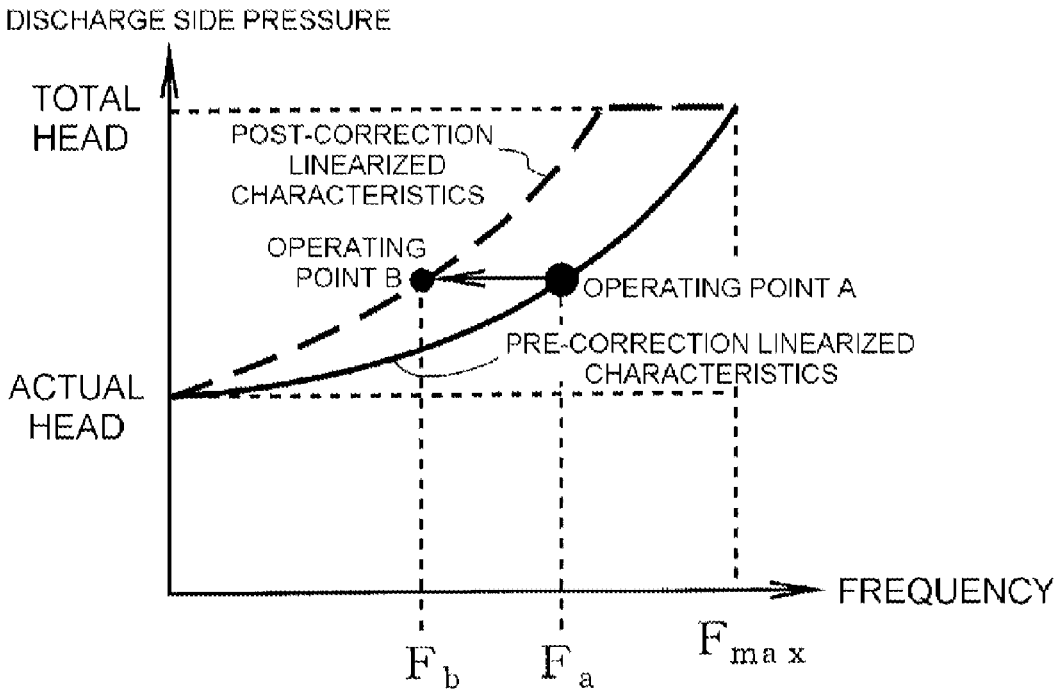
FIG. 4B is an illustration of frequency-head characteristics (F-H characteristics).
Figure 4C:
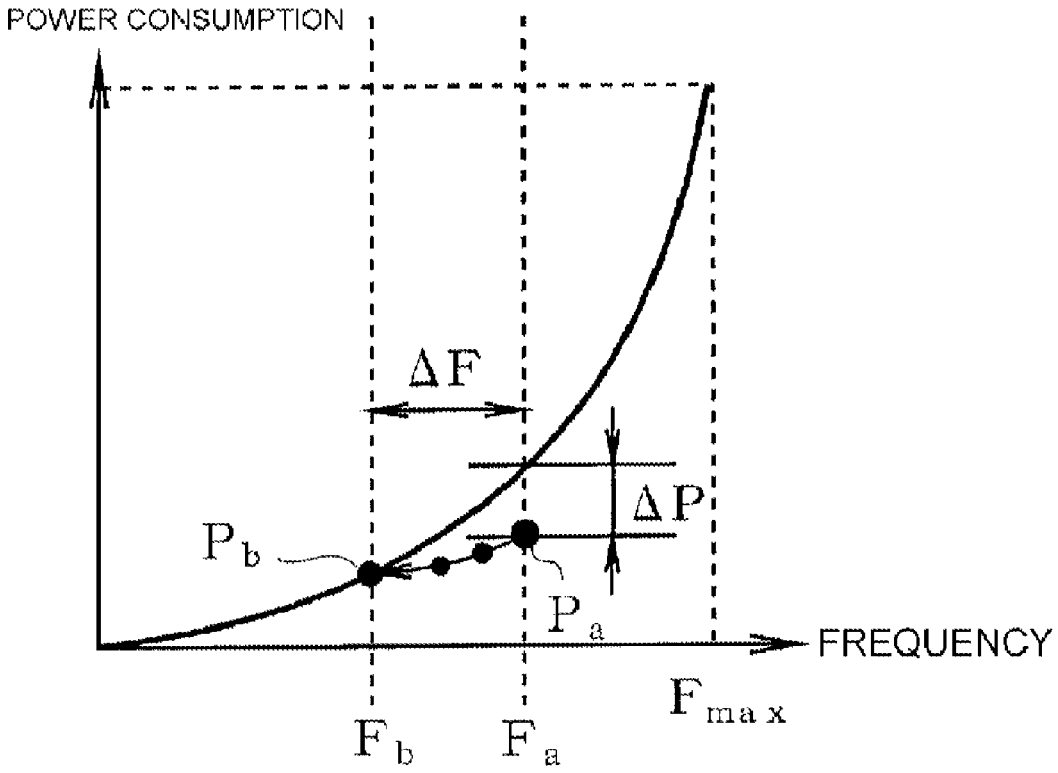
FIG. 4C is an illustration of frequency-power characteristics (F-P characteristics).
Figure 5:
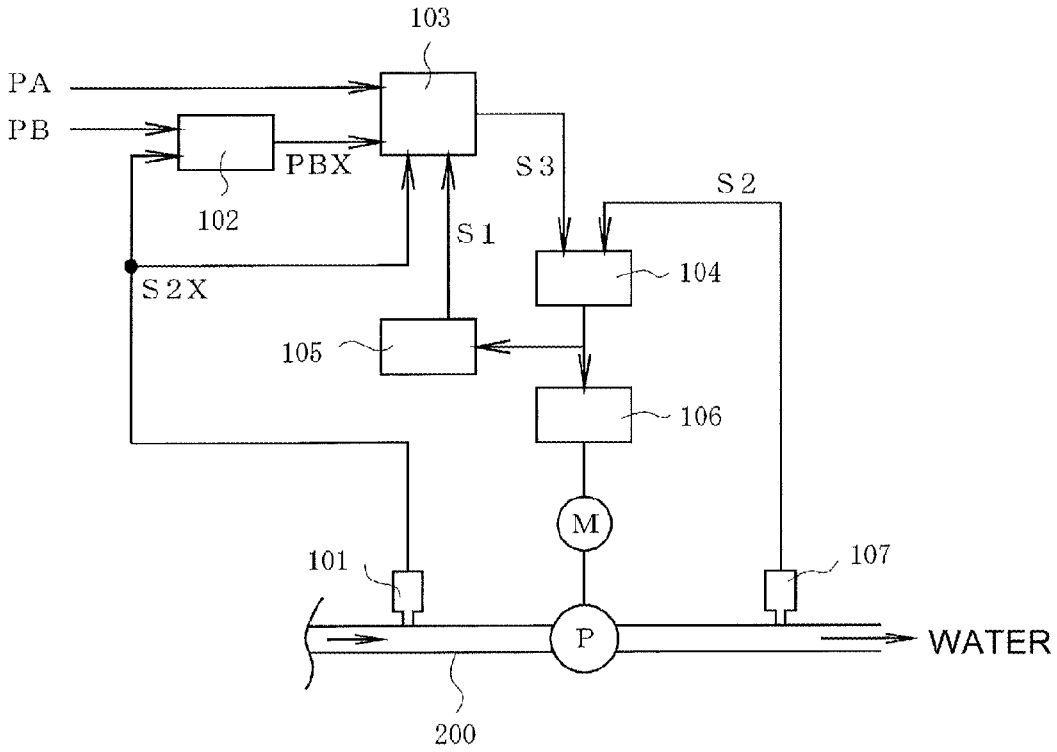
FIG. 5 is a configuration diagram of heretofore known technology according to JP-A-5-133343.
Figure 6:
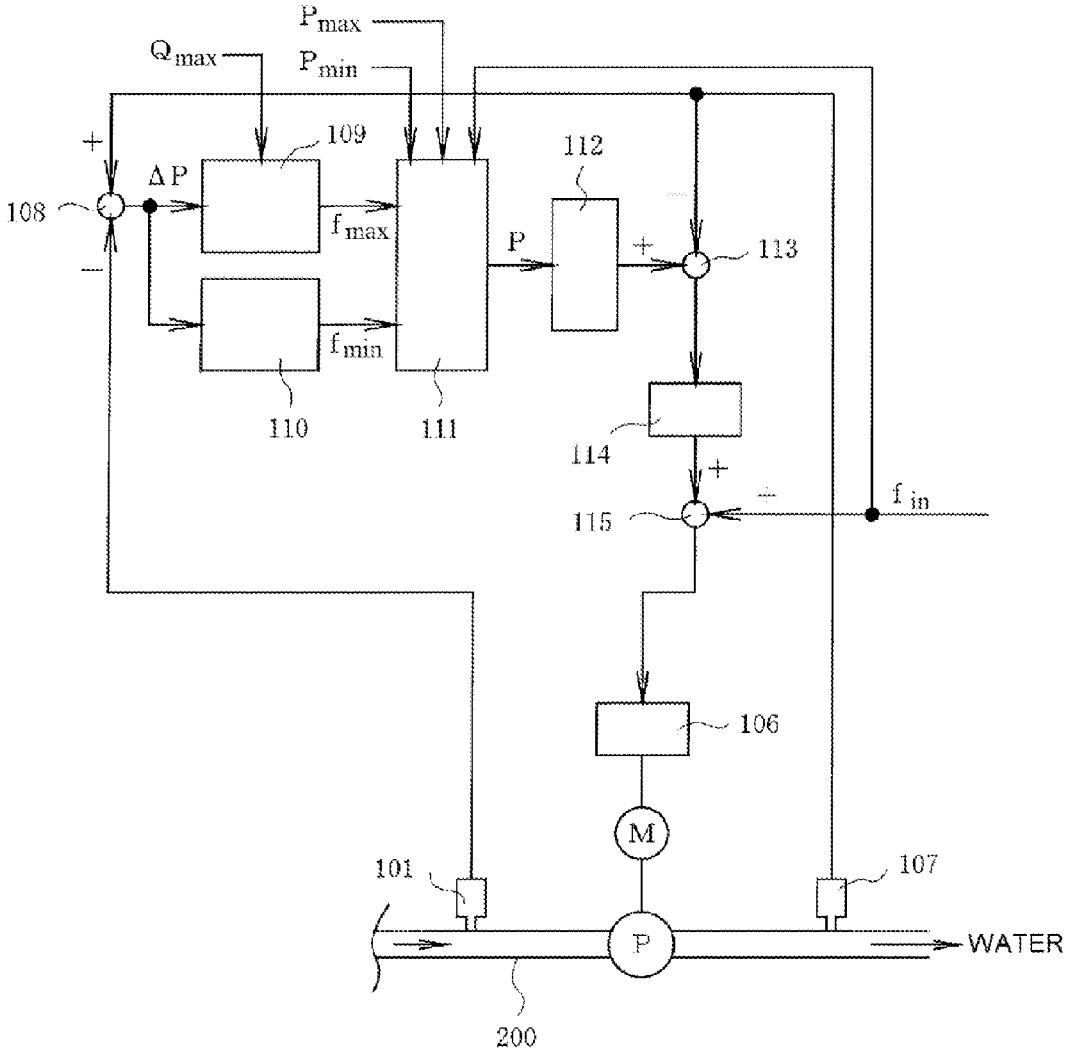
FIG. 6 is a configuration diagram of heretofore known technology according to JP-A-2001-123962.

In FIG. 4C, the relationship between the frequency $F_a$ of the inverter unit 401 corresponding to the operating point A of FIG. 4B and the power consumption deviates from the F-P characteristics shown by the solid line when there is boost pressure, as shown at an operating point $P_a$ of FIG. 4C. The F-P characteristic error determination means 308 of FIG. 1 obtains the operating point $P_a$ from the frequency command f* output by the acceleration means 304 and the power consumption obtained by the power consumption calculation means 305, and determines whether or not there is deviation (an error) between the operating point $P_a$ and the F-P characteristics. As a result of this, when it is determined that there is a deviation equal to or greater than a predetermined value between the operating point $P_a$ and the F-P characteristics, a signal for switching the switching means 309 to the "Error" side and closing the switching means 311 is output.

In FIG. 4C, continuing operation with the operating point $P_a$ means operating the inverter unit 401 at high speed at the frequency $F_a$ without taking into consideration a power consumption reduction amount ΔP caused by the boost pressure, and leads to wasteful power consumption. In order to solve this, it is sufficient to move the operating point from the operating point $P_a$ to an operating point $P_b$ within the F-P characteristics.

Therefore, linearization correction control means 307 of FIG. 1 calculates a frequency difference ΔF between the operating points $P_a$ and $P_b$, and inputs the frequency difference ΔF into the acceleration means 304 via the switching means 309. At this time, the switching means 309 is switched to the "Error" side by an operation of the F-P characteristic error determination means 308.

The acceleration means 304 of FIG. 1 inputs a signal corresponding to the frequency difference ΔF into the linearized characteristic correction means 310 as the frequency command f*. A discharge side pressure detection value from the pressure sensor 402 is also input into the linearized characteristic correction means 310.

At this time, the switching means 311 is closed, and the linearized characteristic correction means 310 corrects the linearized characteristics 301 from the pre-correction linearized characteristics shown by the solid line in FIG. 4B to the post-correction linearized characteristics shown by the broken line in FIG. 4B, with a total head obtained from the frequency command f* and discharge side pressure detection value as an upper limit pressure. The post-correction linearized characteristics are stored in the memory (not shown) as a function or data table, thereby configuring the linearized characteristics 301 in FIG. 1.

Subsequently, the switching means 309 is connected to the "No Error" side and the switching means 311 opened, and the deviation between a target pressure chosen based on the post-correction linearized characteristics 301 and the discharge side pressure detection value from the pressure sensor 402 is input into the PID control means 303. The output of the PID control means 303 is input into the acceleration means 304 via the switching means 309, and the frequency command f* is computed by the acceleration means 304 and provided to the inverter unit 401.

Subsequently, the frequency command f* is generated by a PID control in accordance with the target pressure based on the post-correction linearized characteristics, the pump P discharge side pressure is maintained at the target pressure by controlling the output frequency of the inverter unit 401, and an estimated constant end pressure control is carried out. Also, every time an error occurs between the F-P characteristics and operating point due to the boost pressure, it is sufficient that the heretofore described linearized characteristic correction process is repeated.

When the amount of feed water to be provided or the pump P boost pressure changes, causing a change in the discharge side pressure, the operating point deviates from the F-P characteristics of FIG. 4C in the event that the linearized characteristic correction amount is small. In this case, it is sufficient to re-correct the linearized characteristics by calculating the frequency difference ΔF when the operating point deviates from the F-P characteristics, and gradually reducing the target pressure of the post-correction linearized characteristics, so that the operating point returns to within the F-P characteristics.

As opposed to this, in the event that the linearized characteristic correction amount is large, the operating point exists within the F-P characteristics, but the amount of feed water is insufficient. In this case, it is sufficient to correct the linearized characteristics by gradually increasing the target pressure of the linearized characteristics, calculating the frequency difference ΔF when the operating point deviates from the F-P characteristics, and utilizing the fact that the frequency and quantity are proportional, thereby correlating the linearized characteristics with the pipeline resistance curve of FIG. 4A.

The invention claimed is:

1. A water feed pump control device that carries out an estimated constant end pressure control by controlling the operating speed of a feed water pump installed in a feed water pipe with an inverter device, the feed water pump control device comprising:

a first storage device that stores linearized characteristics showing the relationship between the output frequency of the inverter device and a discharge side pressure;

a pressure sensor that detects the discharge side pressure of the feed water pump;

a power consumption calculation device that calculates the power consumption of the inverter device;

a second storage device that stores F-P characteristics showing the relationship between the output frequency of the inverter device and the power consumption;

a determination device that determines the presence or absence of a boost pressure of the feed water pump based on the inverter device output frequency, power consumption, and F-P characteristics; and a correction device that corrects the linearized characteristics when it is determined by the determination device that there is boost pressure.

2. The feed water pump control device according to claim 1, wherein the discharge side pressure of the feed water pump is positioned on a pipeline resistance curve.

3. The feed water pump control device according to claim 1, wherein the discharge side pressure of the linearized characteristics is taken as a target pressure, and a frequency command is issued based on the deviation between the target pressure and a discharge side pressure detection value of the feed water pump.

4. The feed water pump control device according to claim 3, wherein when an operating point obtained from the frequency command and the power consumption calculated by the power consumption calculation device deviates from the F-P characteristics by a predetermined value or more, it is determined by the determination device that there is boost pressure.

5. The feed water pump control device according to claim 3, wherein when it is determined by the determination device that there is boost pressure, the linearized characteristics are corrected using the discharge side pressure detection value obtained by the pressure sensor and the frequency command.

6. The feed water pump control device according to claim 4, wherein when it is determined by the determination device that there is boost pressure, the linearized characteristics are corrected using the discharge side pressure detection value obtained by the pressure sensor and the frequency command.

7. A pump assembly, comprising:

a feed water pipe;

a feed water pump installed in the feed water pipe; and a water feed pump control device that carries out an estimated constant end pressure control by controlling the operating speed of the feed water pump installed in the feed water pipe with an inverter device, the feed water pump control device including:

a first storage device that stores linearized characteristics showing the relationship between the output frequency of the inverter device and a discharge side pressure;

a pressure sensor that detects the discharge side pressure of the feed water pump;

a power consumption calculation device that calculates the power consumption of the inverter device;

a second storage device that stores F-P characteristics showing the relationship between the output frequency of the inverter device and the power consumption;

a determination device that determines the presence or absence of a boost pressure of the feed water pump based on the inverter device output frequency, power consumption, and F-P characteristics; and a correction device that corrects the linearized characteristics when it is determined by the determination device that there is boost pressure;

wherein the discharge side pressure of the feed water pump is positioned on a pipeline resistance curve.

* * * * *